US005459989A

United States Patent [19]

Genevray

[11] Patent Number: 5,459,989

[45] Date of Patent: Oct. 24, 1995

[54] PRESSER FINGER HAVING A TAPERED SLOT FOR BANKS OF SPINDLES

[75] Inventor: Henri Genevray, Guebwiller, France

[73] Assignee: N. Schlumberger et Cie, S.A., Guebwiller, France

[21] Appl. No.: 946,831

[22] Filed: Sep. 18, 1992

[30] Foreign Application Priority Data

Sep. 18, 1991 [FR] France ..... 91 11774

[51] Int. Cl.[6] ..... D01H 7/32

[52] U.S. Cl. ..... 57/117

[58] Field of Search ..... 57/117, 114, 267, 57/269, 270, 226, 278, 352; 242/19, 26.1, 34, 45

[56] References Cited

U.S. PATENT DOCUMENTS

| | | | |
|---|---|---|---|
| 1,048,920 | 12/1912 | Watzlawik | 57/117 |
| 1,569,534 | 1/1926 | Carlson . | |
| 3,389,547 | 6/1968 | Kühl | 57/117 |
| 4,196,575 | 4/1980 | Novak | 57/267 |

FOREIGN PATENT DOCUMENTS

| | | | |
|---|---|---|---|
| 0428826 | 5/1991 | European Pat. Off. . | |
| 3023241 | 1/1982 | Germany | 57/117 |
| 3931124 | 5/1992 | Germany . | |
| 13072 | of 1850 | United Kingdom | 57/117 |
| 879 | of 1855 | United Kingdom | 37/117 |
| 1127 | of 1865 | United Kingdom | 57/117 |
| 20776 | of 1911 | United Kingdom | 57/117 |
| 459672 | 1/1937 | United Kingdom . | |

*Primary Examiner*—Clifford D. Crowder
*Assistant Examiner*—Larry D. Worrell, Jr.
*Attorney, Agent, or Firm*—Young & Thompson

[57] ABSTRACT

A presser finger for banks of spindles, that has a slot (1) opening at one end in a hole (2) for passage of the yarn (6), closed at its other end and having a transverse cross section less than the thickness of the yarn. The slot can be wedge-shaped, or it can have parallel edges smoothly machined at acute angles.

1 Claim, 2 Drawing Sheets

PRESSER FINGER HAVING A TAPERED SLOT FOR BANKS OF SPINDLES

The present invention relates to the field of the textile industry, particularly the banks of spindles for long fibers and more particularly the presser finger forming an integral part of the flyer and serving to wind the yarn on the bobbin, which is to say serving for the forming of the bobbin and has for its object such a presser finger.

At present, the majority of banks of spindles are generally provided with automatic bobbin lifting which consists in removing the full bobbins from the bank and replacing them by empty bobbins. To this end, it is necessary to break at a given moment the yarn of each bobbin.

The present invention has for its object to provide an improvement in the breaking of each yarn.

It thus has for its object a presser finger for banks of spindles characterized in that it is essentially provided with a slot opening at one end in a hole for passage of the yarn, closed at its other end and having a transverse cross section less than the thickness of the yarn.

The invention will be better understood from the following description, which relates to a preferred embodiment given by way of non-limiting example and explained with reference to the accompanying schematic drawings, in which.

Figure 1:
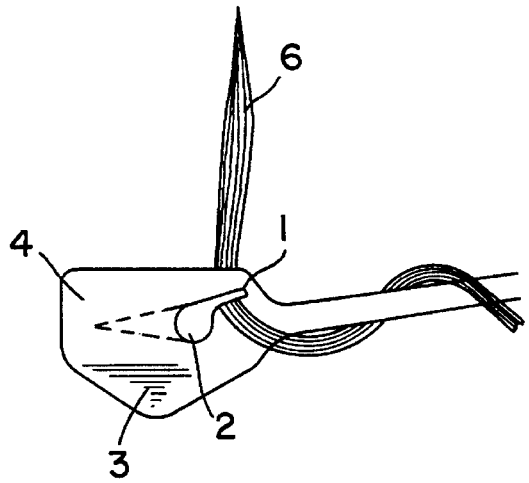
FIG. 1 is a view from above of a presser finger according to the invention in position for breaking the yarn.
Figure 2:
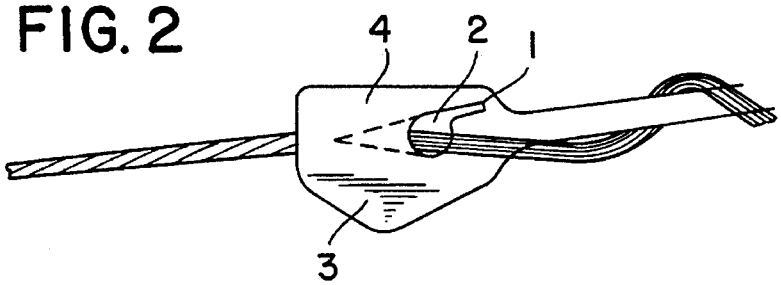
FIG. 2 is a view similar to that of FIG. 1 of the finger in bobbin winding position.

According to the invention and as is shown by way of example in FIGS. 1 and 2 of the accompanying drawings, the presser finger 4 for banks of spindles is essentially provided with a slot 1 opening at one end in a passage opening 2 for the yarn 6, closed at its other end and having a transverse cross section less than the thickness of the yarn.

Thus, when breaking the yarn by a vertically upwardly movement of the bobbin 5, the yarn 6 leaves the guide hole 2 and lodges in the slot 1, which is so dimensioned as to block the yarn during the resulting vertical traction, from which follows a breaking of the yarn 6 taking place forcefully between the bobbin 5 and the presser finger 4 (FIG. 1).

Such a breakage is effected for each yarn 6 of the bank of spindles during automatic raising of the bobbins 5.

Such a breaking process has the advantage of avoiding breaking of the yarn 6 within the flyer or on the presser finger 4, which would involve difficulty in starting the winding of a new bobbin. Thus, during the return movement of the machine, the yarn 6 is drawn horizontally and automatically leaves for this reason the slot 1 so as to resume its normal position shown in FIG. 2, which is to say passing through the hole 2.

Figure 4:
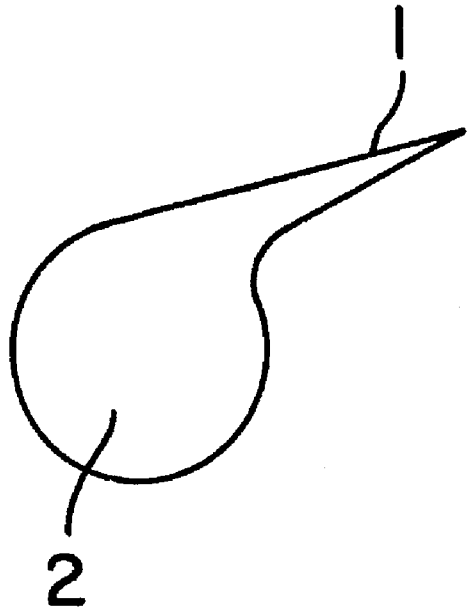
FIGS. 4 and 5 show two modifications of possible embodiments of the slots for blocking the yarn.

According to a characteristic of the invention, the slot 1 has a tapered shape ensuring the automatic wedging of the yarn 6 no matter what its size (FIG. 4).

Figure 5:
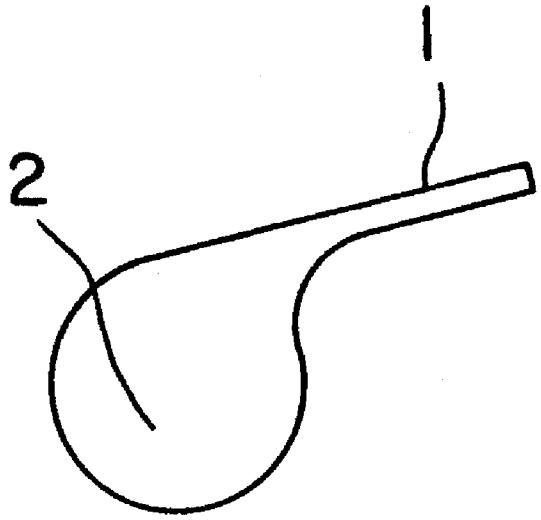

It is also possible, as shown in FIG. 5, to provide a slot 1 with parallel edges. The edges of the slot 1 are machined cleanly at acute angles. Such an embodiment of the edges of the slot 1 is adapted to better ensure the wedging of the yarn 6, without thereby hooking on to the fibers.

Figure 3:
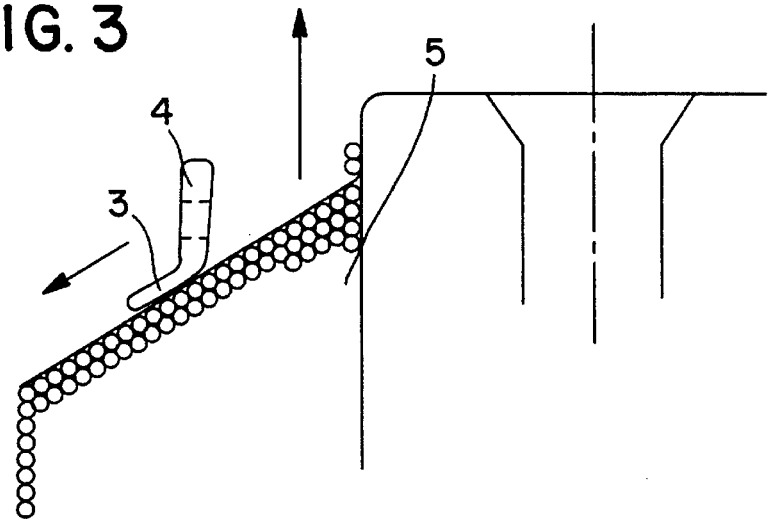
FIG. 3 is a view partially in cross section and in side elevation, from the left of FIGS. 1 and 2, of the presser finger against a bobbin during the course of formation.

According to another characteristic of the invention, and as shown more particularly in FIGS. 1–3, the presser finger 4 is preferably provided with a deflector plate 3. Such a plate 3 is adapted to prevent the presser finger 4 from hooking into the turns of the bobbin 5 during a vertical movement upwardly of the bobbin.

This plate 3 thus slides without catching, on the cone of the bobbin 5 and effects the opening of the presser finger despite the traction of the yarn 6.

The deflector plate 3 preferably has a substantial angle relative to the vertical, so as to match the shape of the cone of the bobbin avoiding hooking the windings of this latter and so as to promote the opening of the presser finger 4.

The inclination of the deflector plate 3 relative to the vertical is preferably comprised between 100° and 150°.

Thanks to the invention, it is possible to provide a presser finger for banks of spindles permitting easy breaking of the yarn at the end of the winding operation, while ensuring the presence of an end of said yarn below the presser finger at the beginning of the winding of a new bobbin.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. Presser finger for banks of spindles, having a slot (1) therethrough having two ends and opening at one said end in a hole (2) for passage of various sized yarns (6), closed at the other said end and having a transverse cross section less than the thickness of the yarn, wherein the slot (1) has a tapered form ensuring wedging of the yarn (6) no matter what the size of the yarn.

* * * * *